US005338189A

United States Patent [19]

Hata et al.

[11] Patent Number: 5,338,189

[45] Date of Patent: Aug. 16, 1994

[54] HEAT TREAT FURNACE

[75] Inventors: Yoshitaka Hata; Tetsuya Kuga; Hidekazu Kurihara; Toshihiko Kogame, all of Nagaokakyo, Japan

[73] Assignee: Murata Manufacturing Co., Ltd., Japan

[21] Appl. No.: 16,666

[22] Filed: Feb. 10, 1993

[30] Foreign Application Priority Data

Feb. 10, 1992 [JP] Japan ..... 4-057498

[51] Int. Cl.[5] ..... F27B 7/00

[52] U.S. Cl. ..... 432/124; 432/103; 432/239; 432/261

[58] Field of Search ..... 432/103, 124, 135, 141, 432/144, 162, 163, 184, 231, 239, 261

[56] References Cited

U.S. PATENT DOCUMENTS 2,707,629 5/1955 Kennedy ..... 432/124
4,288,215 9/1981 Grim ..... 432/103
4,369,585 1/1983 Berkoff et al. ..... 432/239
4,395,184 7/1983 Braden .
5,019,689 5/1991 Bollien et al. ..... 432/124

FOREIGN PATENT DOCUMENTS 4329011 4/1991 Japan .

*Primary Examiner*—Henry C. Yuen
*Attorney, Agent, or Firm*—Ostrolenk, Faber, Gerb & Soffen

[57] ABSTRACT

A holding plate holding a number of chip components coated with electrode paste is carried into a furnace body. The furnace body includes a rotator which is intermittently rotated about a shaft. The rotator is provided with a plurality of radial blades, each of which is provided with a pair of inward holding grooves for holding both side portions of the holding plate. The holding plate is carried to an inlet portion and outlet portion by a conveyor and the plate is inserted into the holding grooves by an introduction arm. The furnace is provided with heaters and fans to dry the electrode paste during rotation of the rotator.

12 Claims, 7 Drawing Sheets

HEAT TREAT FURNACE

BACKGROUND OF THE INVENTION

1. Field of the Invention

The present invention relates to a heat treat furnace, such as a drying furnace or a curing oven, and more particularly, it relates to the structure of a furnace for heat treating plate type workpieces.

2. Description of the Related Art

In order to simultaneously apply electrodes to end portions of a number of chip components, a holding plate is generally employed for elastically holding the chip components, as disclosed in U.S. Pat. No. 4,395,184. This holding plate comprises a hard substrate which is provided on its center with a thin flat plate portion having a number of through holes and a rubber-like elastic member embedded in a cavity defined by the flat plate portion and provided with receiving holes passing through the portions corresponding to the through holes.

When external electrodes are formed at the end portions of chip components by using such a holding plate, the chip components are held by the receiving holes so that they are partially upwardly projected from the plate. Then the plate is placed on a conveyor and carried to pass under a roll which is coated with electrode paste. Thus, the electrode paste is applied to the projected portions of the chip components, and then the plate is conveyed under heating means, so that the electrode paste is heated and dried.

In the case of such heating means, the electrode paste can be applied to the chip components and then dried while the components remain on the same conveyor. However, since the heating means is installed along the direction for carrying the plate, the installation space must be increased, resulting in inferior efficiency in the drying step.

Alternatively, it is possible to provide a batch type drying furnace in an intermediate portion of such a conveyor so that a plurality of holding plates carried by the conveyor are simultaneously inserted into the drying furnace to be subjected the prescribed drying and then discharged from this furnace. In this case, however, it is necessary to keep the plates in a waiting state for a certain time since only a certain number of plates continuously carried on the conveyor can be collectively inserted in the drying furnace at one time. This leads to waste of time.

It is also possible to replace the aforementioned batch type drying furnace with a vertical conveyor so that externally carried holding plates are inserted one by one onto the vertical conveyor to be subjected to continuous drying. In this case, the treatment time can be reduced since there is no need to keep the plates in a waiting state, and the installation floor space can be reduced by virtue of the vertical conveyor. However, the conveyor structure in the furnace is complicated and the chip components are vibrated during passage through the furnace dropped from the receiving holes of the plates.

SUMMARY OF THE INVENTION

Accordingly, an object of the present invention is to provide a heat treat furnace which can continuously treat workpieces in a simple structure and which can heat treat the workpieces with as little vibration as possible.

Another object of the present invention is to provide a heat treat furnace having high treatment efficiency.

A heat treat furnace according to the present invention comprises a furnace body and a rotator which is rotatably arranged in the furnace body and is provided with a plurality of holding means along its rotational direction at regular angles. The rotator is intermittently rotated by a drive means at a pitch interval corresponding to the angle between each adjacent pair of holding means. Heating means is provided in the furnace body for heating workpieces, and inlet and outlet portions are provided in the furnace body facing at least one of stopped positions of each holding means. The heat treat furnace further comprises introduction means for inserting the workpieces into the holding means through the inlet portion, and discharge means for discharging the workpieces held by the holding means from the furnace body through the outlet portion.

Untreated plate type workpieces are carried to the front of the furnace body, and inserted into the inlet portion of the furnace body by the introduction means. The inlet portion corresponds to one of the stopped positions of each holding means of the rotator. When a workpiece is introduced into the furnace, the rotator stops temporarily so that its holding means receives the workpiece. In this way the workpiece is smoothly inserted into each holding means through the inlet portion. The workpiece inserted in the holding means is rotated in the furnace body following the intermittent rotation of the rotator, and heat treated during passage through a heating zone of a prescribed temperature. When the as-treated workpiece reaches the outlet portion, the rotator is temporarily stopped so that the workpiece is discharged to the exterior of the furnace by the discharge means.

Thus, the rotator is temporarily stopped after every 1-pitch rotation to substantially continuously heat treat the workpieces while carrying them from the inlet portion to the outlet portion.

When the rotator is rotated in the furnace, the workpieces are not subjected to a large amount of vibration. Therefore, even when the workpieces are formed by holding plates which hold a number of chip components, it is possible to prevent the chip components from dropping off. Further, the rotator is extremely simple in structure, since it may be simply rotated about its axis.

The rotator is preferably provided with a plurality of radial blades with holding means for holding workpieces one by one, so that they can efficiently hold a number of workpieces. When each of such blades is provided with a pair of inner and outer inward holding grooves for holding both sides of each workpiece and when it is rotated about a horizontal axis, the workpiece is prevented from dropping off even if it is not held by any clamp means. In this case, the workpieces may simply be slid in the horizontal direction to be inserted into or discharged from the rotator, whereby introducing and discharging operations are simplified with simple introduction and discharge means.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
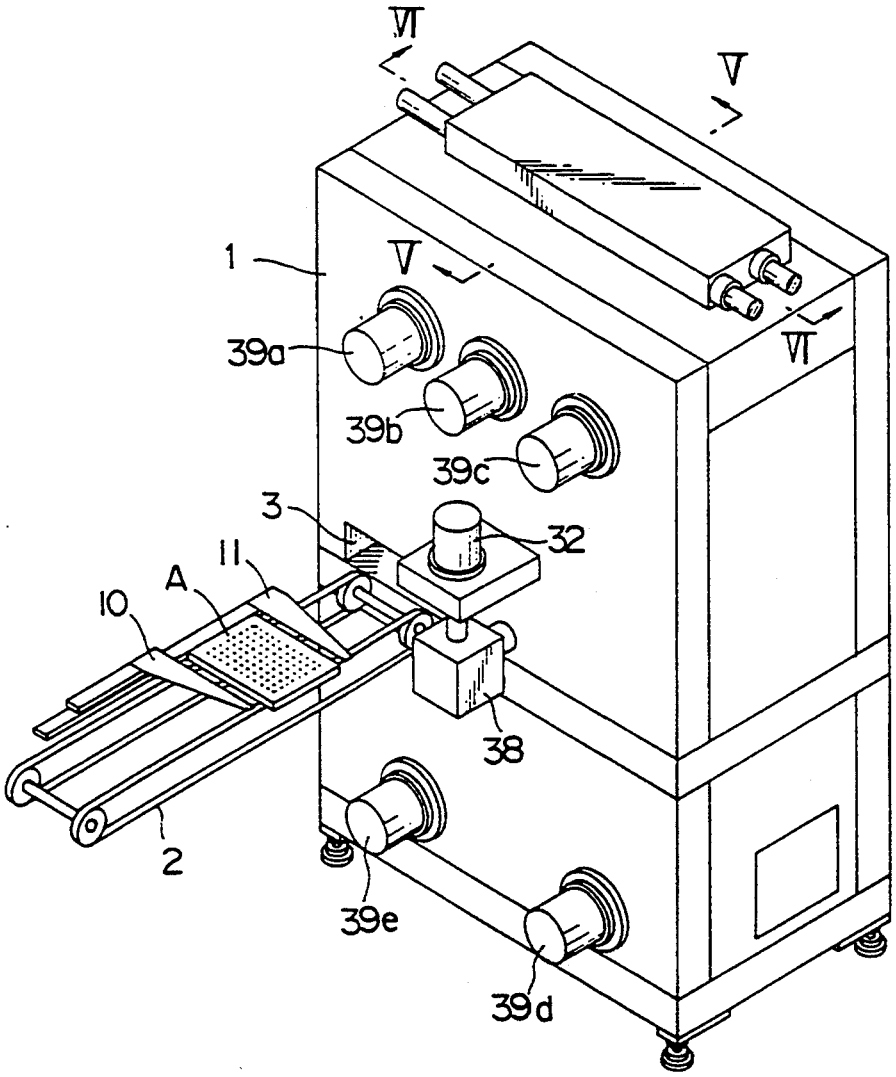
FIG. 1 is a perspective view showing a heat treat furnace according to the present invention, which is applied to a drying furnace.
Figure 2:
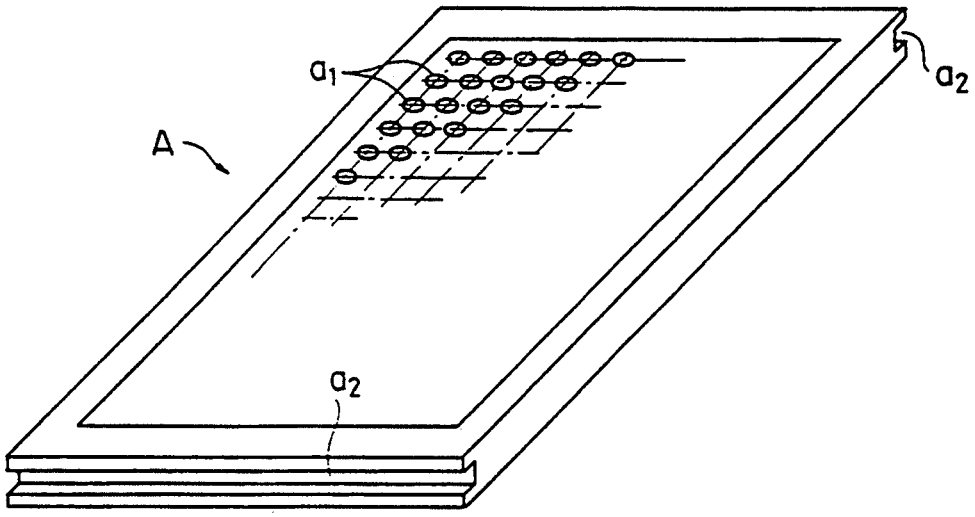
FIG. 2 is a perspective view showing an exemplary holding plate employed in the present invention.
Figure 3:
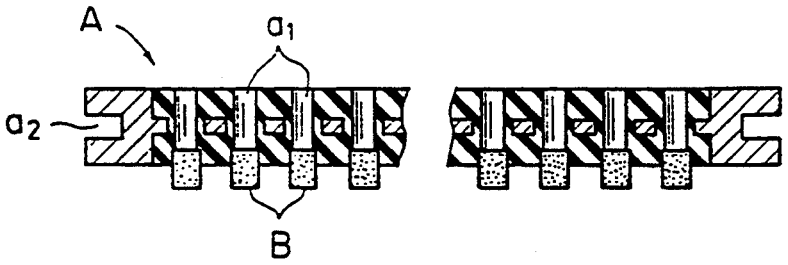
FIG. 3 is a cross-sectional view of the holding plate of FIG. 2.

FIG. 1 illustrates a heat treat furnace according to the present invention, which is applied to a drying furnace. According to this embodiment, a holding plate A holding a number of chip components B is employed as a workpiece, as shown in FIGS. 2 and 3. The holding plate A is provided with a number of receiving holes $a_1$, which elastically hold the chip components B so that the components B are partially downwardly projected from the holes $a_1$. After the projected portions of the components B are coated with electrode paste such as silver, the plate A is carried to a furnace body 1 by a reversely drivable belt conveyor 2 which works for both introducing and discharging the plate A. The furnace body 1, which is adapted to heat and dry the electrode paste applied to the components B, is provided with a port 3 which serves as both an inlet portion and an outlet portion in a position corresponding to the belt conveyor 2. A front end portion of the conveyor 2 is inserted into the furnace body 1 through the port 3.

Figure 4A:
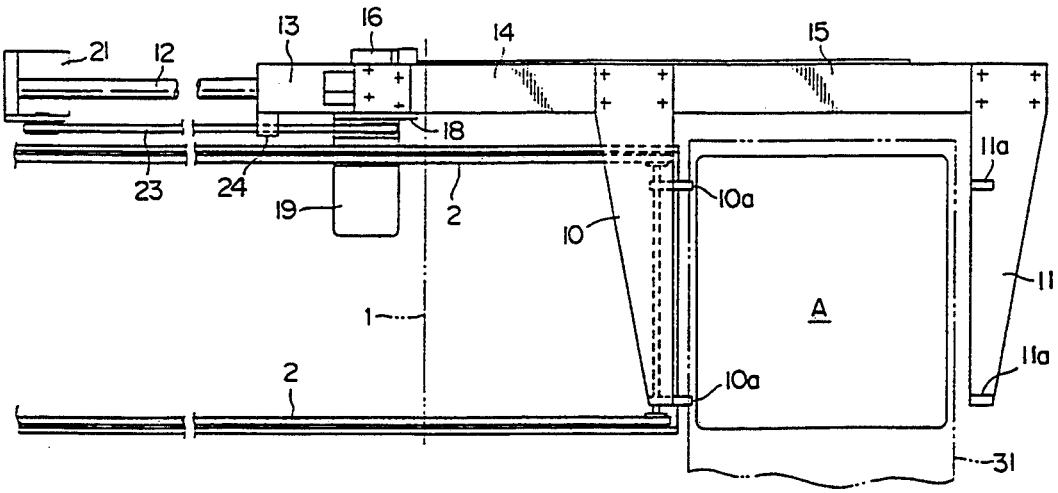
FIG. 4*a* is a plan view of the introduction and discharge means.
Figure 4B:
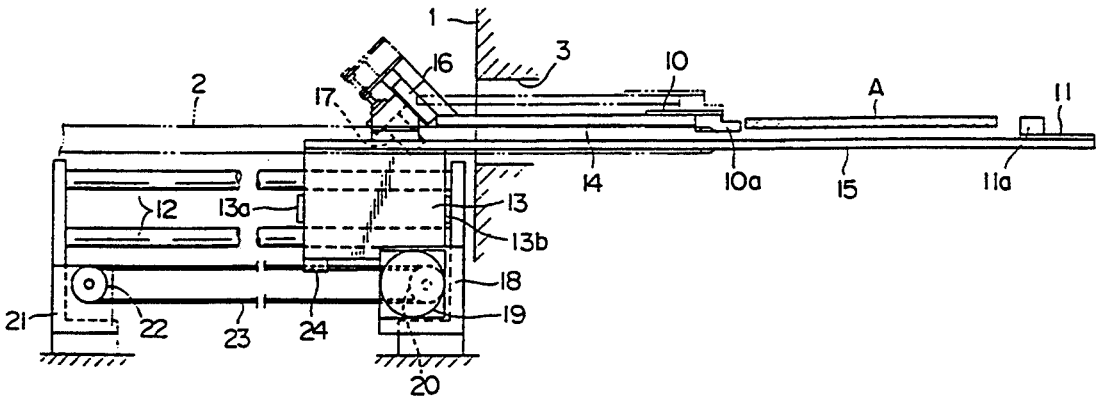
FIG. 4*b* is a front elevational view showing the introduction and discharge means.

A pair of introduction and discharge arms 10 and 11, forming introduction and discharge means, are provided in portions close to the port 3 of the furnace body 1. As shown in FIGS. 4*a* and 4*b*, the arms 10 and 11 are horizontally supported through support plates 14 and 15 by a head portion 13 which is slid along two slide shafts 12, being parallel to the conveyor 2. The introduction and discharge arms 10 and 11 are provided with introduction and discharge projections 10*a* and 11*a* respectively facing each other (FIG. 4*b*), so that projections 10*a* and 11*a* push rear or front surfaces of the holding plate A for introducing or discharging the plate A into or from a rotator 31 provided in the furnace body 1, as described later.

The introduction arm 10 and the support plate 14 are supported on the head portion 13 in an obliquely upwardly slidable manner through a slide bearing 16. An air cylinder 17 is driven to upwardly move the introduction arm 10 to a position shown by two-dot chain lines in FIG. 4*b*. When the introduction arm 10 is thus upwardly moved, the projection 10*a* for introduction is located on a position higher than a carrier level of the conveyor 2, whereby the plate A can pass through under the projection 10*a*.

A motor 19 is fixed to a bracket 18 which supports first ends of the slide shafts 12, while a belt 23 is extended along a pulley 20 which is mounted on the rotary shaft of the motor 19 and another pulley 22 which is mounted on another bracket 21 supporting second end portions of the slide shafts 12. A clamp portion 24 is provided under the head portion 13 for partially clamping the belt 23, so that it is possible to integrally horizontally reciprocate the head portion 13, i.e., the introduction and discharge arms 10 and 11 by driving the motor 19.

In order to introduce the plate A into the rotator 31 of the furnace body 1, the motor 19 is driven to stop the introduction and discharge arms 10 and 11 at a rear end position where a rear stopper 13*a* of the head portion 13 comes into contact with the bracket 21. At this time, the introduction arm 10 is located outside the body 1 in a position upwardly moved by the air cylinder 17. Then the conveyor 2 is forwardly driven so that the plate A passes through under the introduction arm 10 to be stopped at a front end position of the belt conveyor 2, i.e., an intermediate portion between the arms 10 and 11. Then the air cylinder 17 is driven to downwardly move the introduction arm 10, thereby the projection 10*a* of this introduction arm 10 is located behind the rear surface of the plate A. The motor 19 is driven to integrally move the introduction and discharge arms 10 and 11 to a front end position where the front stopper 13*b* of the head portion 13 comes into contact with the bracket 18, whereby the plate A is pushed by the projection 10*a* to be transferred from the conveyor 2 to the rotator 31 as hereinafter described (see FIGS. 4*a* and 4*b*).

In order to discharge the plate A from the furnace body 1, on the other hand, the introduction arm 10 is upwardly moved while the introduction and discharge arms 10 and 11 are moved to the rear end position. Thus, the front surface of the plate A is pushed by the projection 11*a* of the discharge arm 11, so that the plate A is transferred from the rotator 31 to the conveyor 2. Then the conveyor 2 is backward driven, so that the plate A passes through under the introduction arm 10 to be conveyed to a following step.

When the plate A is transferred from the conveyor 2 to the rotator 31 or vice versa, the conveyor 2 is preferably driven in synchronization with the introduction and discharge arms 10 and 11, to reduce the vibration of the plate A.

Figure 5:
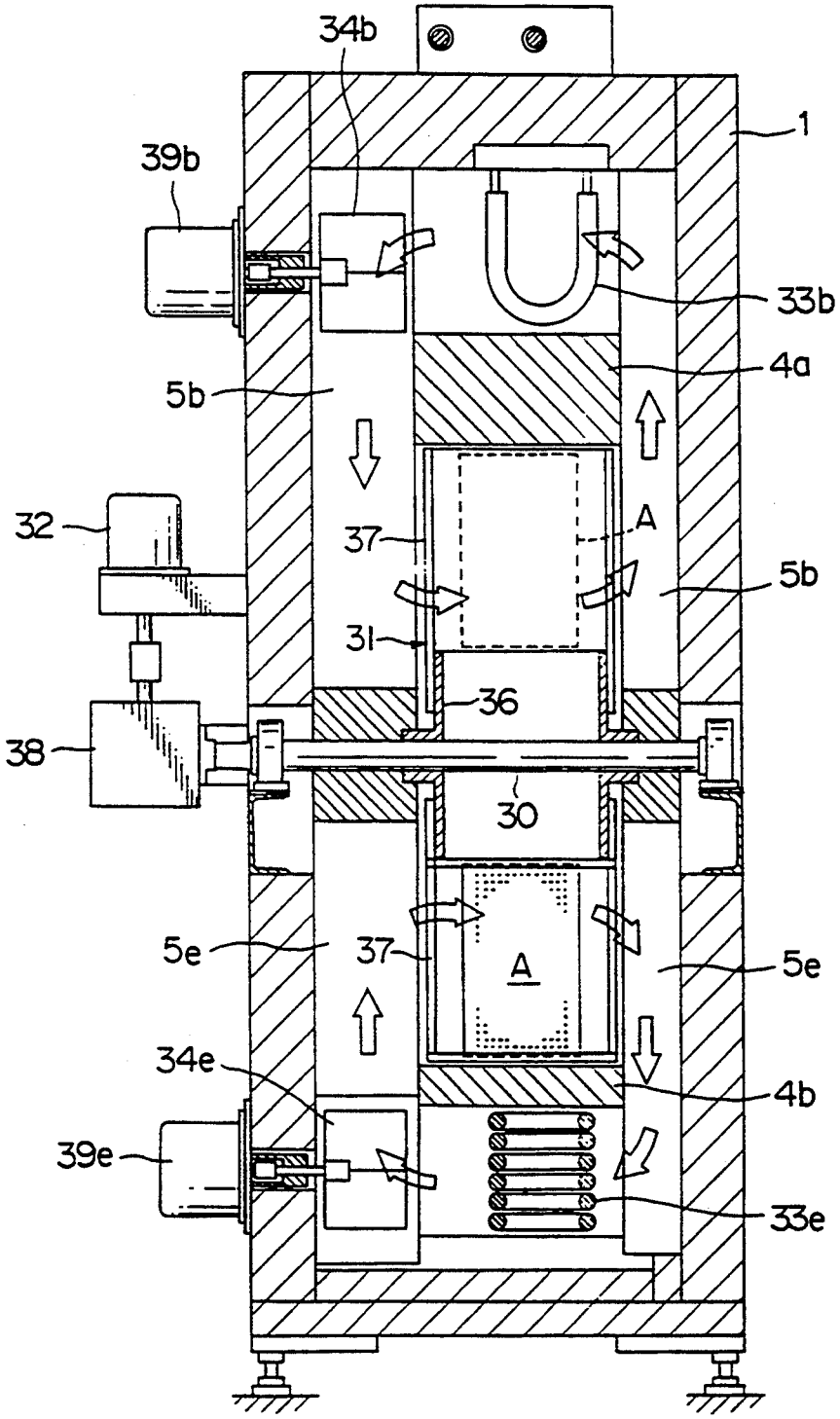
FIG. 5 is a cross-sectional view taken along the line V—V in FIG. 1.
Figure 6:
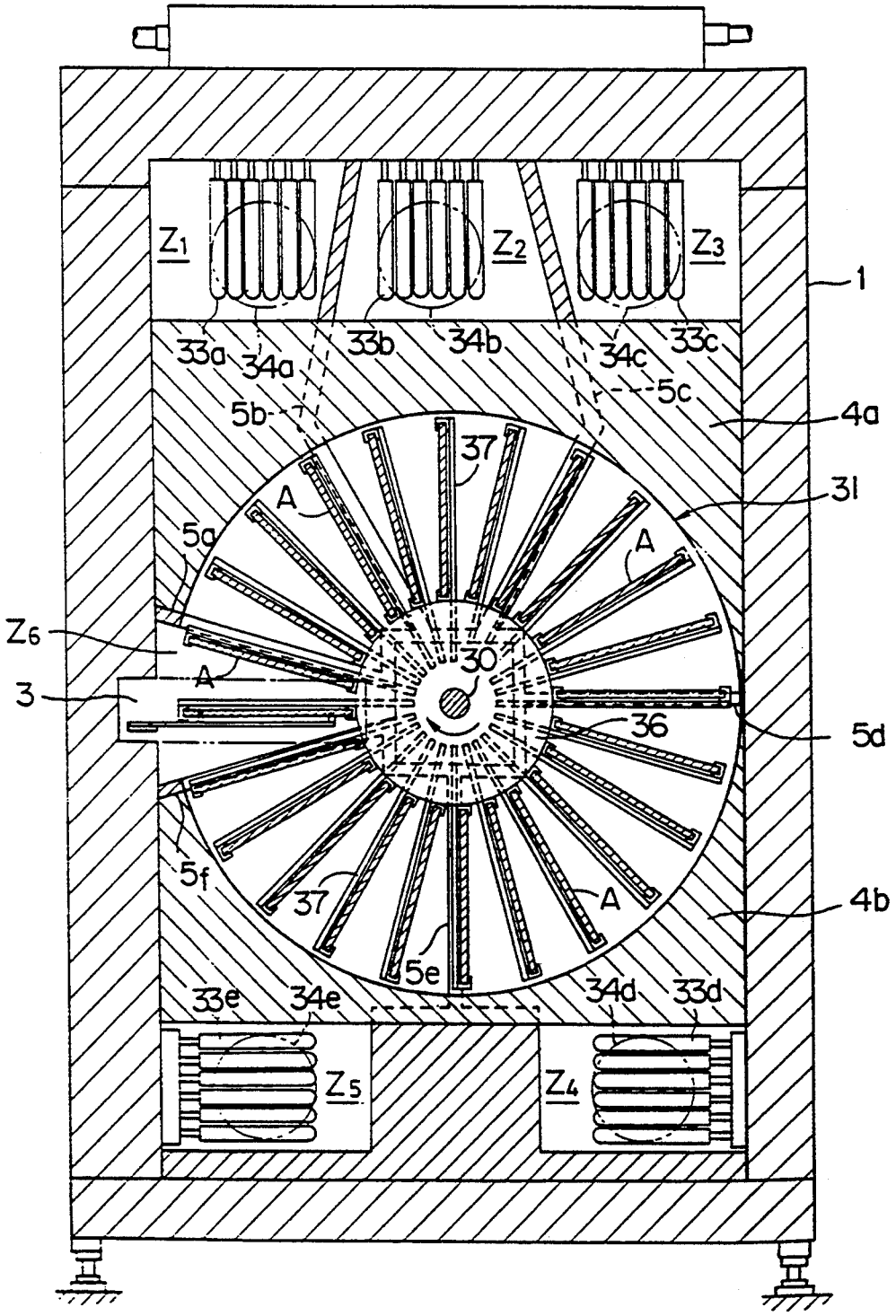
FIG. 6 is a cross-sectional view taken along the line VI—VI in FIG. 1.

As shown in FIGS. 5 and 6, the furnace body 1 is provided with the rotator 31 which is rotatable about a horizontal shaft 30, a motor 32 for intermittently rotating the rotator 31 at a constant pitch, a plurality of heaters 33*a* to 33*e*, and fans 34*a* to 34*e* for convection heat from the heaters 33*a* to 33*e* respectively along arrows shown in FIG. 5. The fans 34*a* to 34*e* are driven by fan motors 39*a* to 39*e* respectively.

Figure 7:
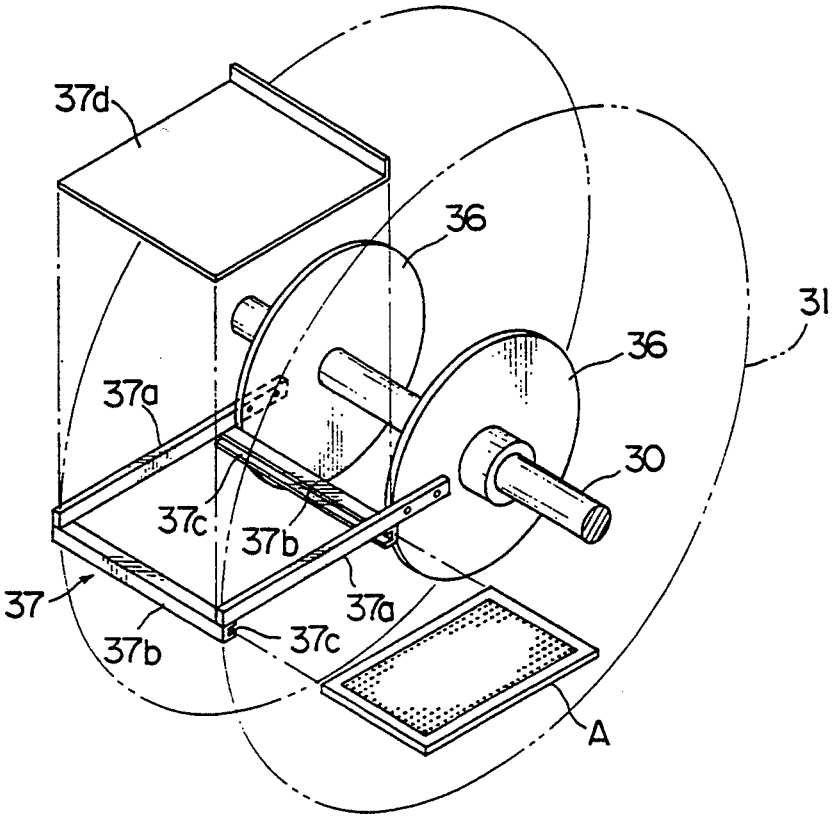
FIG. 7 is a perspective view showing a rotator.

As shown in FIG. 7, the rotator 31 is formed by a pair of hubs 36 which are fixed to the shaft 30 and a plurality of blades 37 which are fixed to the hubs 36 at constant angles (FIG. 7 shows only one of the blades 37). Each blade 37 has a pair of longitudinal frames 37*a* which project radially from the hubs 36, a pair of horizontal frames 37*b* which are fixed perpendicular to these frames 37*a*, and a cover 37*d* which is fixed on one side surfaces of the frames 37*b* (on upper side surfaces in FIG. 7) so that it closes the opening surrounded by the frames 37*a* and 37*b*. On inward surfaces of the horizontal frames 37*b* there are provided a pair of holding grooves 37*c* facing each other. The plate A carried to the port 3 by the conveyor 2 is inserted in the holding grooves 37*c* of the blade 37 stopping behind the port 3 by the introduction arm 10 in a horizontal state. Since the lower surface (the surface where chip components partially project) of the plate A inserted into the grooves 37*c* is opened, the chip components are not brought into contact with the blade 37 and ventilation is effectively attained.

The motor 32 intermittently rotates the shaft 30 through a reduction mechanism 38 at a constant pitch, with a pitch angle which is equal to the angle (about 15 degrees in this embodiment) between each adjacent pair of the blades 37. Thus, it is possible to correctly stop the blade 37 at the position corresponding to the port 3. The stopping period of the motor 32 is set to be slightly longer than the sum of the periods for discharging and introducing the plate A.

In the furnace body 1 there are provided arch-shaped cross beams 4*a* and 4*b* bridged between both inner sides of the body 1, and six partitions 5*a* to 5*f* each being fixed at the same angle with one of the stopped positions of the blades 37. The cross beams 4*a* and 4*b* are set in close to the periphery of the blades 37 while the partitions 5*a* to 5*f* are set in close to both sides of the blades 37. By these cross beams 4*a* and 4*b* and partitions 5*a* to 5*f*, the interior of the furnace body 1 is partitioned into six zones $Z_1 \sim Z_6$. Also, since the openings of the blades 37 are closed by the cover 37*d*, the hot air may not go through the blades 37 between adjacent zones.

The holding plate A held by the rotator 31 in the aforementioned manner passes through the five heating zones $Z_1$ to $Z_5$ during the 360 degree rotation of the rotator 31, so that the electrode paste applied to the chip components B is dried. Among the heating zones, the heating zone $Z_1$ which is close to the port 3 is set at a relatively low temperature, while the heating zone $Z_2$ is set at an intermediate temperature, the heating zones $Z_3$ and $Z_4$ are set at high temperatures and the final heating zone $Z_5$ is set at an intermediate temperature respectively along the rotational direction. Zone $Z_6$, corresponding to the port 3, is open to the outside air. Thus, it is possible to dry the electrode paste without applying strong thermal shock to the chip components B, as well as to suppress heat emission from the port 3 to the minimum.

The temperatures of the heating zones $Z_1$ to $Z_5$ are not restricted to the above, but can be arbitrarily set by a temperature controller. Further, regions of the heating zones $Z_1$ to $Z_5$ and the rotational direction of the rotator 31 can also be arbitrarily changed.

When the as-dried holding plate A reaches the port 3, the discharge arm 11 pulls this holding plate A onto the belt conveyor 2. The conveyor 2, which is reversely drivable, is preferably driven backward driven in synchronization with the discharge arm 11. The plate A thus transferred to the conveyor 2 is carried in reverse to the subsequent processing step (not shown).

After the dried plate A is carried to the subsequent processing step, a next untreated holding plate A is carried into the furnace body 1 by the conveyor 2, and inserted in the rotator 31 by the introduction arm 10. The rotator 31 is stopped while the dried plate A is discharged and the next untreated plate A is introduced.

Figure 8:
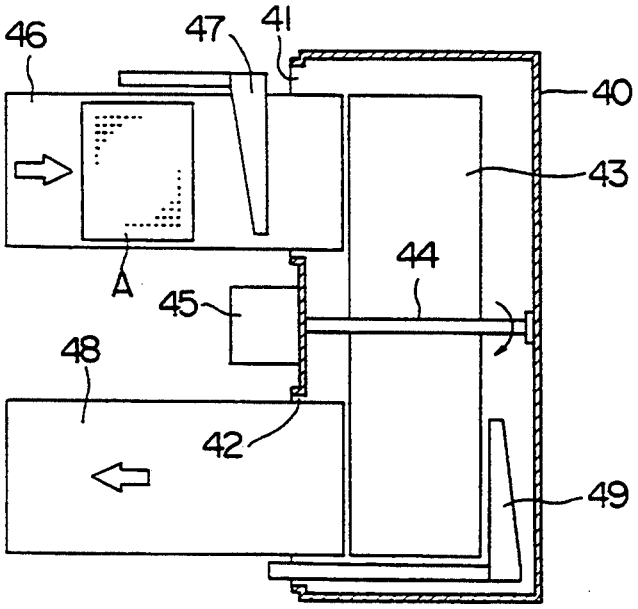
FIG. 8 is a cross sectional view showing the internal structure of a second embodiment of the present invention.

FIG. 8 shows a second embodiment of the present invention. While the electrode paste is dried during rotation of the rotator 31 in a 360-degree arc and the single port 3 serves both as an inlet port and an outlet port in the first embodiment, an inlet port 41 and an outlet port 42 are provided at 180-degree symmetrical positions on a front side of a drying furnace 40, so that electrode paste is dried during rotation of a rotator 43 in a 180-degree arc in this embodiment. Numeral 44 denotes a rotary shaft, and numeral 45 denotes a motor. At the inlet port 41 there is provided an introduction conveyor 46 and an introduction arm 47, while at the outlet port 42 there is provided a discharge conveyor 48 and a discharge arm 49. Whereas the internal structure of the drying furnace 40 is substantially similar to that of the first embodiment (see FIG. 5), no heating means is provided in a lower half interior of this furnace.

In this case, the lower half interior of the furnace cannot be effectively used as compared with the drying furnace according to the first embodiment. However, since holding plate A is introduced into the inlet port 41 with downwardly directing electrode surfaces, and discharged from the outlet port 42 with upwardly directed electrode surfaces, it is easy to check the finished states of the electrodes. Further, the inlet and outlet ports 41 and 42 are provided independently to enable synchronous introduction and discharge of plates A, whereby the period for such introduction and discharge can be reduced.

Figure 9:
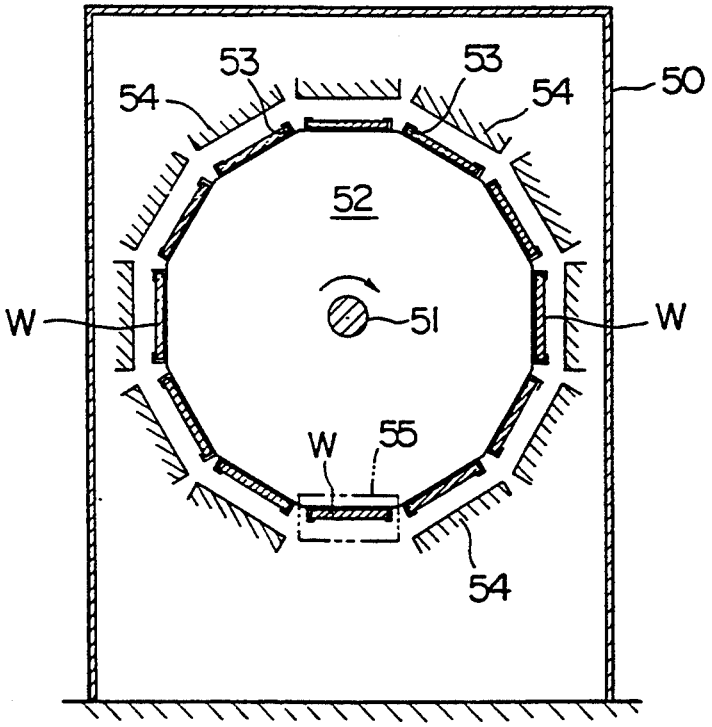
FIG. 9 is a longitudinal cross-sectional view showing the internal structure of a third embodiment of the present invention.

FIG. 9 shows a third embodiment of the present invention. According to this embodiment, a shaft 51 is horizontally rotatably supported in a furnace body 50, and a polygonal drum type rotator 52 is fixed on this shaft 51. Each outer peripheral surface of the rotator 52 has a pair of inward holding grooves 53 for holding both sides of a plate type workpiece W. The furnace body 50 is provided in its interior with heaters 54 facing the respective outer peripheral surfaces of the rotator 52, to heat treat the workpiece W by heat radiation from the heaters 54. An inlet and outlet port 55 is provided on the lowermost end of the rotator 52, so that the workpiece W can be inserted into or discharged from the grooves 53 through this port 55 in a horizontal state.

The workpiece W can be introduced into and discharged from the grooves 53 by introduction and discharge arms (not shown) which are similar to those of the aforementioned embodiments.

The aforementioned embodiments show only a few examples of the present invention, and can be modified in various ways within the scope of the present invention, as a matter of course.

In the aforementioned embodiments, for example, the inlet and outlet ports may be provided not only on the same sides (front sides) of the furnaces but also on both sides thereof. In other words, the workpieces may be introduced into the furnace from the front sides to be discharged from the rear sides. However, when the inlet and outlet ports are provided on the same sides, as shown in the aforementioned embodiments, the conveyors can be arranged on single sides of the furnace to decrease the space occupied for this treatment.

Application of the heat treat furnace according to the present invention is not restricted for drying the electrode paste of the chip components B held by the holding plate A, but the present invention is also applicable to another use.

Further, the workpiece is not restricted to the holding plate shown in FIGS. 2 and 3, but the present invention can also be applied to such a holder as described in Japanese Patent Laying-Open Gazette No. 4-329011(1992) filed in the name of the assignee.

Moreover, when the holding plate A shown in FIGS. 2 and 3 is provided with horizontal grooves $a_2$ on both sides, rails may be provided as holding means for engaging with these grooves $a_2$.

Futhermore, the support for the rotary shaft of the rotator is not restricted to the horizontal direction, but this rotary shaft may be vertically supported. In this case, it is advantageous that the posture of the workpiece is not changed by the rotational position of the rotator.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A heat treat furnace for heat treating plate type workpieces, said heat treat furnace comprising:
   - a furnace body;
   - a rotator rotatably mounted in said furnace body;
   - a plurality of holding means provided at regular angles along the direction of rotation of said rotator for holding said workpieces;
   - drive means for intermittently rotating and stopping said rotator at a pitch interval corresponding to an angle between each adjacent pair of said holding means;
   - heating means provided in said furnace body for heating said workpieces held by said holding means;
   - an inlet portion and an outlet portion provided in said furnace body facing at least one stopping position of each of said holdings means;
   - introduction means for inserting said workpieces into said holding means through said inlet portion; and
   - discharge means for discharging said workpieces being held by said holding means from said furnace body through said outlet portion.

2. A heat treat furnace in accordance with claim 1, wherein said rotator is rotatably supported in said furnace body by a rotary shaft, and said holding means including a plurality of blades radially projecting from said rotary shaft.

3. A heat treat furnace in accordance with claim 1, wherein a port which serves as both said inlet portion and said outlet portion is provided on said furnace body, and said workpieces are heat treated during a 360-degree rotation of said rotator.

4. A heat treat furnace in accordance with claim 2, wherein
   - said rotary shaft is rotatably supported by said furnace body in a horizontal state, and each said holding means comprises a pair of holding grooves for holding both side portions of each of said workpieces slidably along an axial direction of said rotator.

5. A heat treat furnace in accordance with claim 2, wherein
   - said furnace body is provided in its interior with a plurality of heating zones being partitioned along a rotational direction of said rotator, and said heating zones are provided with said heating means respectively.

6. A heat treat furnace in accordance with claim 1, wherein said drive means comprises a motor for intermittently driving and stopping said rotator, said motor having a stopping period for inserting or discharging said workpieces from said introduction means and said discharge means.

7. A heat treat furnace in accordance with claim 1, wherein
   - said introduction means comprises a conveyor for carrying said workpieces into said inlet portion and an introduction arm for pushing said workpieces from said conveyor into said holding means.

8. A heat treat furnace in accordance with claim 1, wherein
   - said discharge means comprises a discharge arm for pulling said workpieces from said holding means and a conveyor for carrying said workpieces through said outlet portion.

9. A heat treat furnace in accordance with claim 1, wherein
   - said inlet portion and said outlet portion are provided on symmetrical positions of said furnace body about an axial portion of said rotator so that said workpieces are heat treated during a 180-degree rotation of said rotator.

10. A heat treat furnace in accordance with claim 1, wherein said rotator has a polygonal outer periphery, and said holdings means are provided at intervals along said periphery of said rotator.

11. A heat treat furnace in accordance with claim 10, wherein
   - a plurality of said heating means are provided in the interior of said furnace body, facing said holding means of said rotator.

12. A heat treat furnace in accordance with claim 1, wherein
   - said workpieces comprise holding plates each holding a plurality of chip components coated with electrode paste.

* * * * *